US010464637B1

(12) United States Patent
Yakos et al.

(10) Patent No.: US 10,464,637 B1
(45) Date of Patent: Nov. 5, 2019

(54) QUICK-FILL INFLATABLE WATER CRAFT

(71) Applicants: David J. Yakos, Bozeman, MT (US); Stephen M. Sanford, Bozeman, MT (US); Seth David Carlstrom, Bozeman, MT (US)

(72) Inventors: David J. Yakos, Bozeman, MT (US); Stephen M. Sanford, Bozeman, MT (US); Seth David Carlstrom, Bozeman, MT (US)

( * ) Notice: Subject to any disclaimer, the term of this patent is extended or adjusted under 35 U.S.C. 154(b) by 0 days.

(21) Appl. No.: 15/795,229

(22) Filed: Oct. 26, 2017

Related U.S. Application Data

(60) Provisional application No. 62/413,246, filed on Oct. 26, 2016.

(51) Int. Cl.

| | |
|---|---|
| ***B63B 7/08*** | (2006.01) |
| *B63B 35/79* | (2006.01) |
| *B63B 35/71* | (2006.01) |
| *B63B 35/36* | (2006.01) |
| *A45C 13/10* | (2006.01) |

(52) U.S. Cl.
CPC ..... *B63B 7/08* (2013.01); *A45C 2013/1007* (2013.01); *B63B 35/36* (2013.01); *B63B 35/71* (2013.01); *B63B 35/7913* (2013.01)

(58) Field of Classification Search
CPC ..... A47C 4/54; A47C 27/081; A47C 27/084; A47C 15/004; A47C 15/006; B63B 7/08; B63B 35/36; B63B 35/7913; B63C 9/30; A45C 13/008
See application file for complete search history.

(56) References Cited

U.S. PATENT DOCUMENTS

| | | | | |
|---|---|---|---|---|
| D775,479 | S * | 1/2017 | Oomen | D6/361 |
| 2013/0243354 | A1* | 9/2013 | Lytle | A45C 3/00 383/59 |
| 2014/0254956 | A1* | 9/2014 | Buell, III | B65D 33/00 383/64 |
| 2017/0088241 | A1* | 3/2017 | Souter | B63B 35/83 |
| 2018/0035807 | A1* | 2/2018 | Zonneveld | A47C 1/146 |

OTHER PUBLICATIONS

Mullin, WindPouch Inflatable Hammock Review, Jun. 2, 2016, http://themtblab.com/2016/06/windpouch-inflatable-hammock-review.html, retrieved Jun. 23, 2018 (Year: 2016).*

* cited by examiner

*Primary Examiner* — Andrew Polay
(74) *Attorney, Agent, or Firm* — Quickpatents, LLC; Kevin Prince

(57) ABSTRACT

An inflatable watercraft for supporting a user on water includes a flexible water-proof and air-tight bladder having a first end, an opposing second end, a top side, a bottom side, and two opposing lateral sides. The first end is substantially open to expose an interior surface of the bladder and an interior volume of the bladder. A first seal is fixed with the interior surface of the bladder proximate the open first end of the bladder. As such, to inflate the watercraft the user holds the first seal open while scooping air into the bladder until the bladder achieves a substantially inflated configuration. The user then places the first seal in the closed configuration to prevent air from escaping the bladder. Additional seals and means for inhibiting air leaking from the bladder are provided. Multiple forms of watercraft are contemplated.

18 Claims, 15 Drawing Sheets

QUICK-FILL INFLATABLE WATER CRAFT

CROSS-REFERENCE TO RELATED APPLICATIONS

This application claims the benefit of U.S. Provisional Patent Application 62/413,246, filed on Oct. 26, 2016, and incorporated herein by reference.

STATEMENT REGARDING FEDERALLY SPONSORED RESEARCH AND DEVELOPMENT

Not Applicable.

FIELD OF THE INVENTION

This invention relates to water craft, and more particularly to a quickly-inflatable water craft.

DISCUSSION OF RELATED ART

Many outdoor recreation enthusiasts have been making forays into the world of inflatable watercrafts. But barriers still exist for the average outdoorsman to gain access to inflatable crafts as a useful tool or hobby. On the current market, inflatable crafts fall prey to at least one of the following barriers: time-consuming inflation and deflation times, space constrictions, prohibitive weight constrictions, high cost, low durability, and the like.

Therefore, there is a need for a watercraft device that allows for rapid inflation and deflation without requiring powered air pumps or inflation by mouth. Such a needed invention would be collapsible into a small volume to facilitate transport and storage, and would be lightweight, relatively inexpensive and durable. Further, such a needed device would provide an improved air sealing means to inhibit air leaks. The present invention accomplishes these objectives.

SUMMARY OF THE INVENTION

The present device is an inflatable watercraft for supporting a user on water. A flexible water-proof and air-tight bladder has a first end, an opposing second end, a top side, a bottom side, and two opposing lateral sides. The first end is substantially open to expose an interior surface of the bladder and an interior volume of the bladder.

A first seal is fixed with the interior surface of the bladder proximate the open first end of the bladder. The first seal is preferably configured for allowing an open configuration thereof but preferring a closed configuration thereof. That is, the first seal is urged into the closed configuration.

The first seal preferably includes a resilient top seal strip fixed with the interior surface of the top side of the bladder proximate the open first end of the bladder, as well as an opposing, resilient bottom seal strip fixed with the interior surface of the bottom side of the bladder proximate the open first end of the bladder. The top and bottom seal strips, are resiliently urged together in parallel alignment at substantially flat contact surfaces thereof to seal the first end of the bladder. Opposing ends of each strip, are mutually fixed at the sides of the bladder. In some embodiments the first end of the bladder further includes a leader having a substantially-consistent cross-sectional shape, such that upon sealing of the first seal, the first end of the bladder may be rolled tightly towards the second end of the bladder in a rolled configuration, and then fixed with the two-part mechanical fasteners to reinforce the first seal.

As such, to inflate the watercraft the user holds the first seal open while scooping air into the bladder until the bladder achieves a substantially inflated configuration. The user then places the first seal in the closed configuration to prevent air from escaping the bladder.

Preferably the watercraft includes a pair of two-part mechanical fasteners that are each fixed between one of the two opposing lateral sides of the bladder and the first end of the bladder, preferably at the ends of the strips. As such, when the first seal is in the closed configuration, each mechanical fastener may be fastened to secure the first end of the bladder to one of the lateral sides of the bladder to maintain the closed configuration of the seal.

In some embodiments, the watercraft further includes a second seal between the first seal and the open first end of the bladder. The second seal facilitates the maintaining of the inflated configuration of the bladder, and may include a zip-lock type of seal between the top side and bottom side interior surfaces of the bladder proximate the first end thereof. Alternately the second seal includes a zipper fastener.

The watercraft form may take various shapes, such as an inflatable boat having a floor. In at least one embodiment the floor is inflatable and integrated with the bladder, or may include a separate air bladder inflatable with conventional means such as by mouth or air pump. Alternately the watercraft form may be that of a kayak, a canoe, a stand-up paddle board, a cataraft, or the like.

The present invention is a watercraft device that allows for rapid inflation and deflation without requiring powered air pumps or inflation by mouth. The present invention is collapsible into a small volume to facilitate transport and storage, and is lightweight, relatively inexpensive and durable. Further, the present device provides an improved air sealing means to inhibit air leaks. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
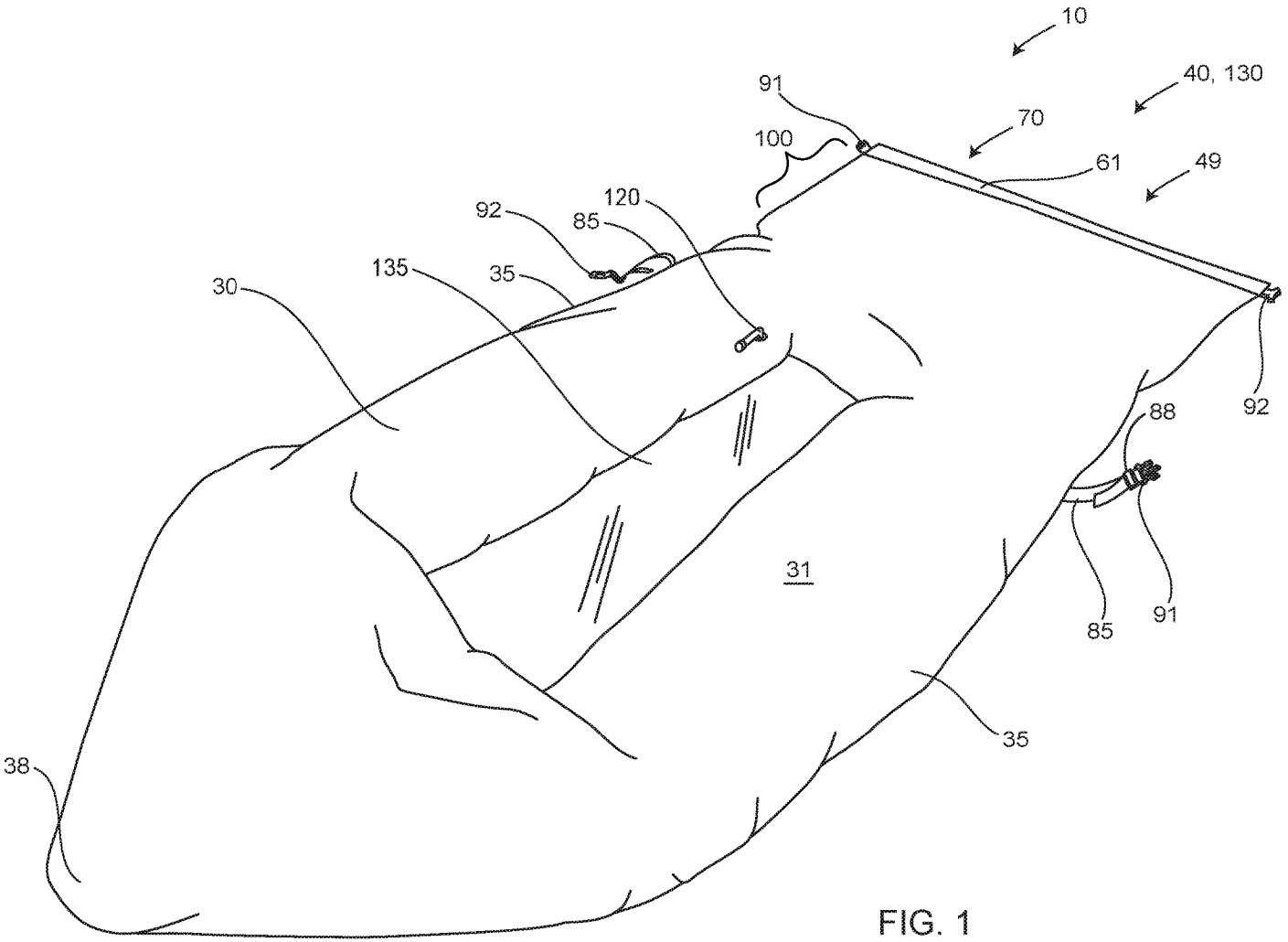
FIG. 1 is a perspective view of the invention, illustrated in a substantially uninflated configuration.
Figure 2:
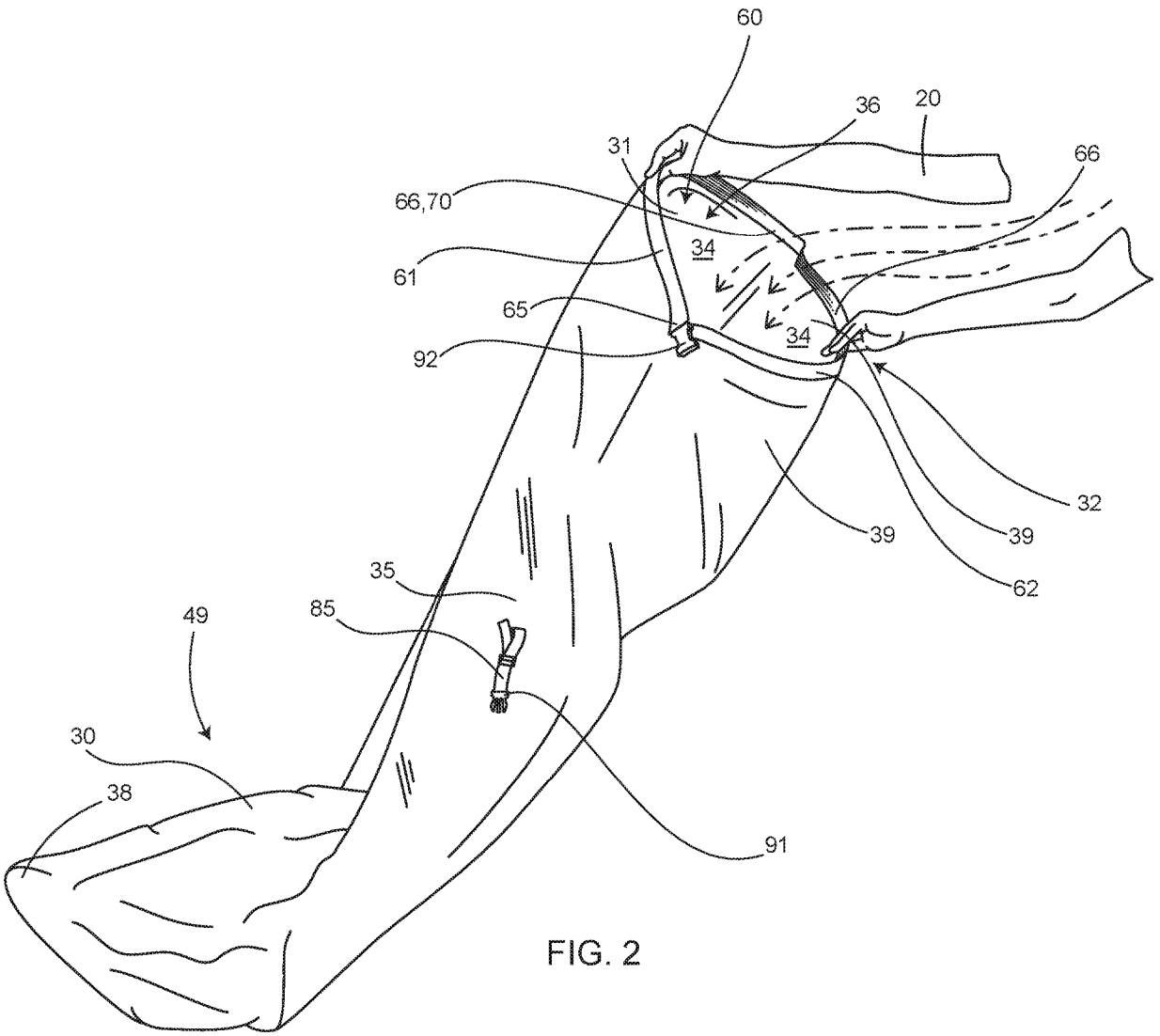
FIG. 2 is a perspective view of the invention, illustrated as a user inflates a bladder of the invention.
Figure 6:
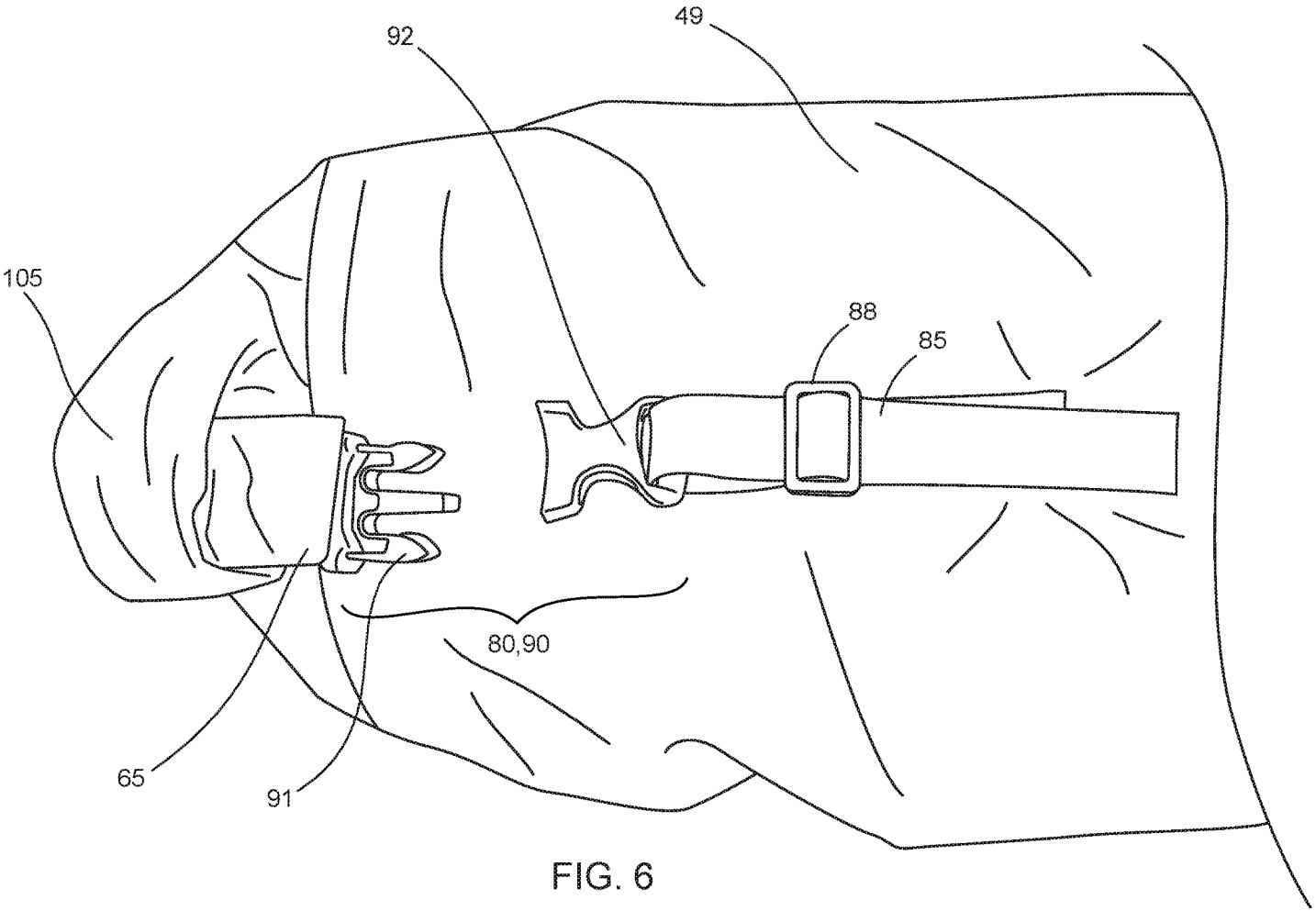
FIG. 6 is a partial perspective view of the invention, illustrating a two-part mechanical fastener about to affix a side of the bladder with the first end of the bladder.
Figure 7:
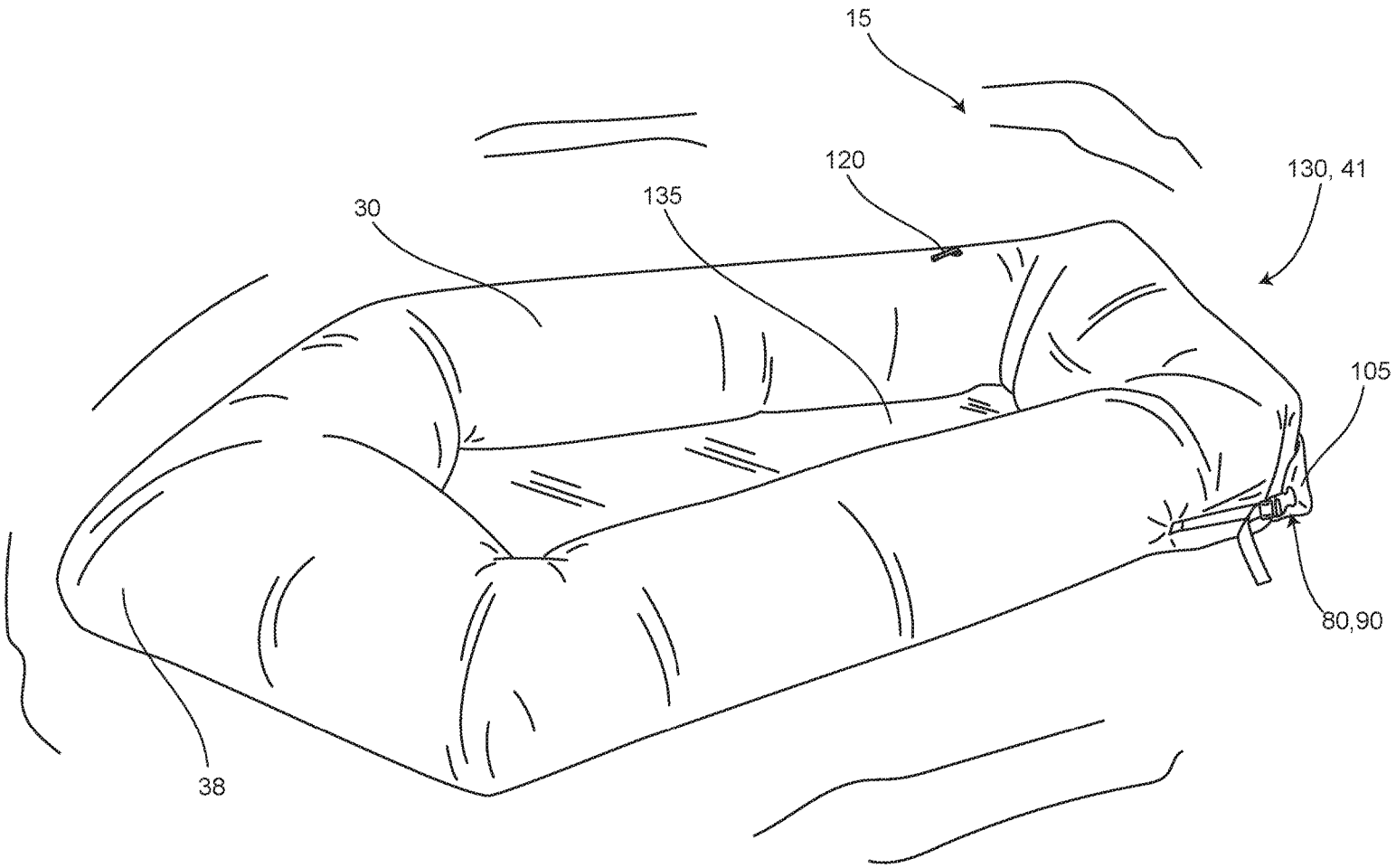
FIG. 7 is a perspective view of the invention, illustrated in a substantially inflated configuration and taking a watercraft form of a boat with a floor.

FIGS. 1-7 illustrate an inflatable watercraft 10 for supporting a user 20 on water 15. A flexible water-proof and air-tight bladder 30 has a first end 32, an opposing second end 38, a top side 31, a bottom side 39, and two opposing lateral sides 35. The bladder 30 assumes a watercraft form 40 when inflated with air (FIGS. 2 and 7). At least one third of the first end 32 is open to expose an interior surface 34 of the bladder 30 and an interior volume 36 of the bladder 30. The bladder 30 is made from a flexible, water-proof and air-tight web material such as nylon, elastomeric-coated flexible web materials, thermoplastic polyurethane (TPU) laminated to polyester or nylon, TPU film, vinyl film or laminate, silnylon, non-woven high-density polyethylene fabrics such as Tyvek (a Trademark of DuPont), a blend of these, or the like.

A first seal 50 is fixed with the interior surface 34 of the bladder proximate the open first end 32 of the bladder 30. The first seal 50 is configured for allowing an open configuration 60 (FIG. 3) but preferring a closed configuration 70 (FIG. 1).

Figure 8:
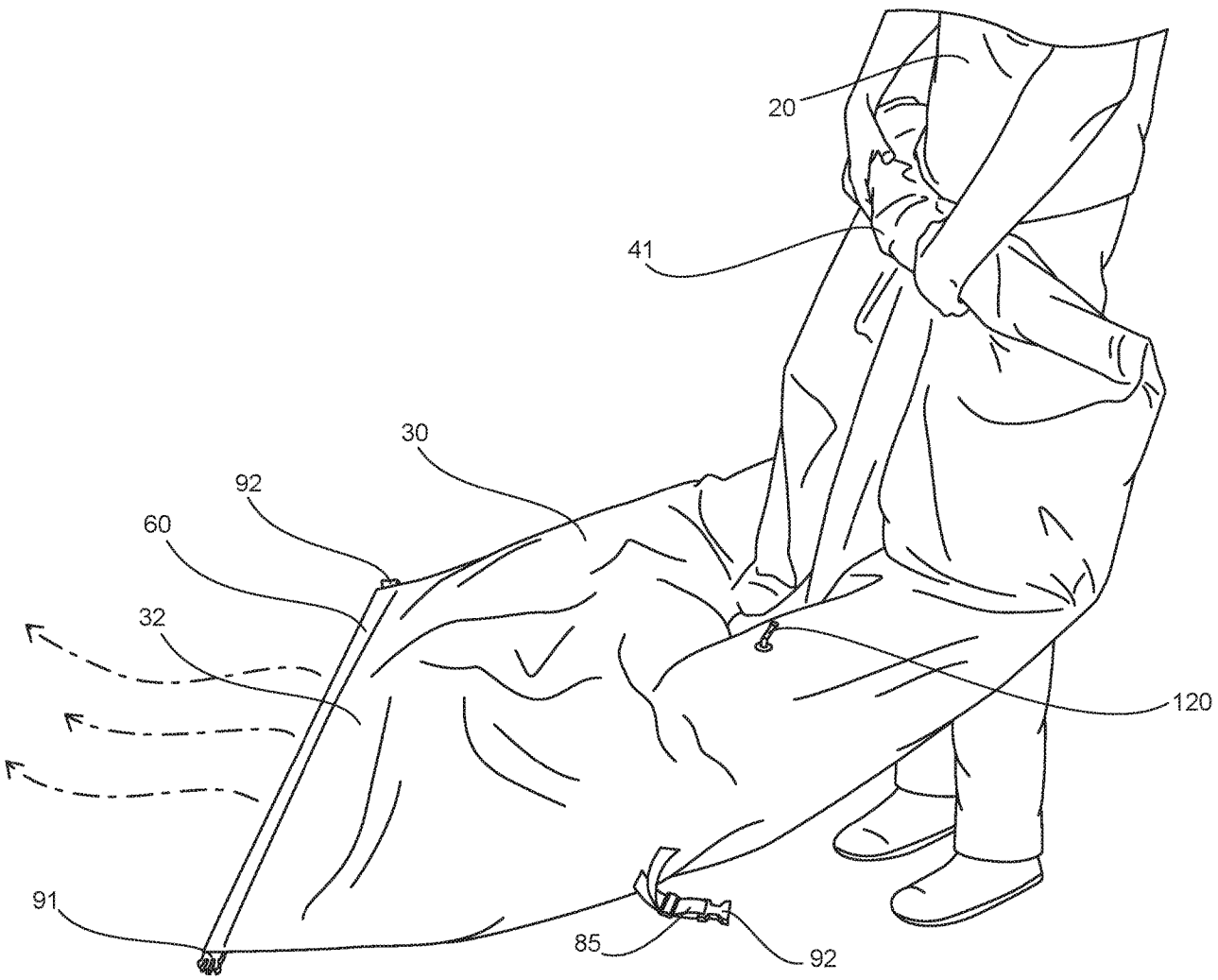
FIG. 8 is a perspective view of the invention, illustrating a user rolling-up the bladder from a second end towards the first end to deflate the bladder.

As such, to inflate the watercraft 10 the user 20 holds the first seal 50 open while scooping air into the bladder 30 until the bladder 30 achieves a substantially inflated configuration 41 (FIGS. 4-7). The user 20 then places the first seal 50 in the closed configuration 70 (closing the seal 50) to prevent air from escaping the bladder 30. Some embodiments further include an auxiliary air valve 120 for allowing the bladder 30 to be inflated by an air pump, by mouth, or for facilitating fine-tuning of the air pressure within the internal volume 36 of the bladder 30. In a deflated configuration 49 (FIG. 8), the bladder 30 may be rolled up into a relatively small volume (not shown) for storage and transport.

Figure 3:
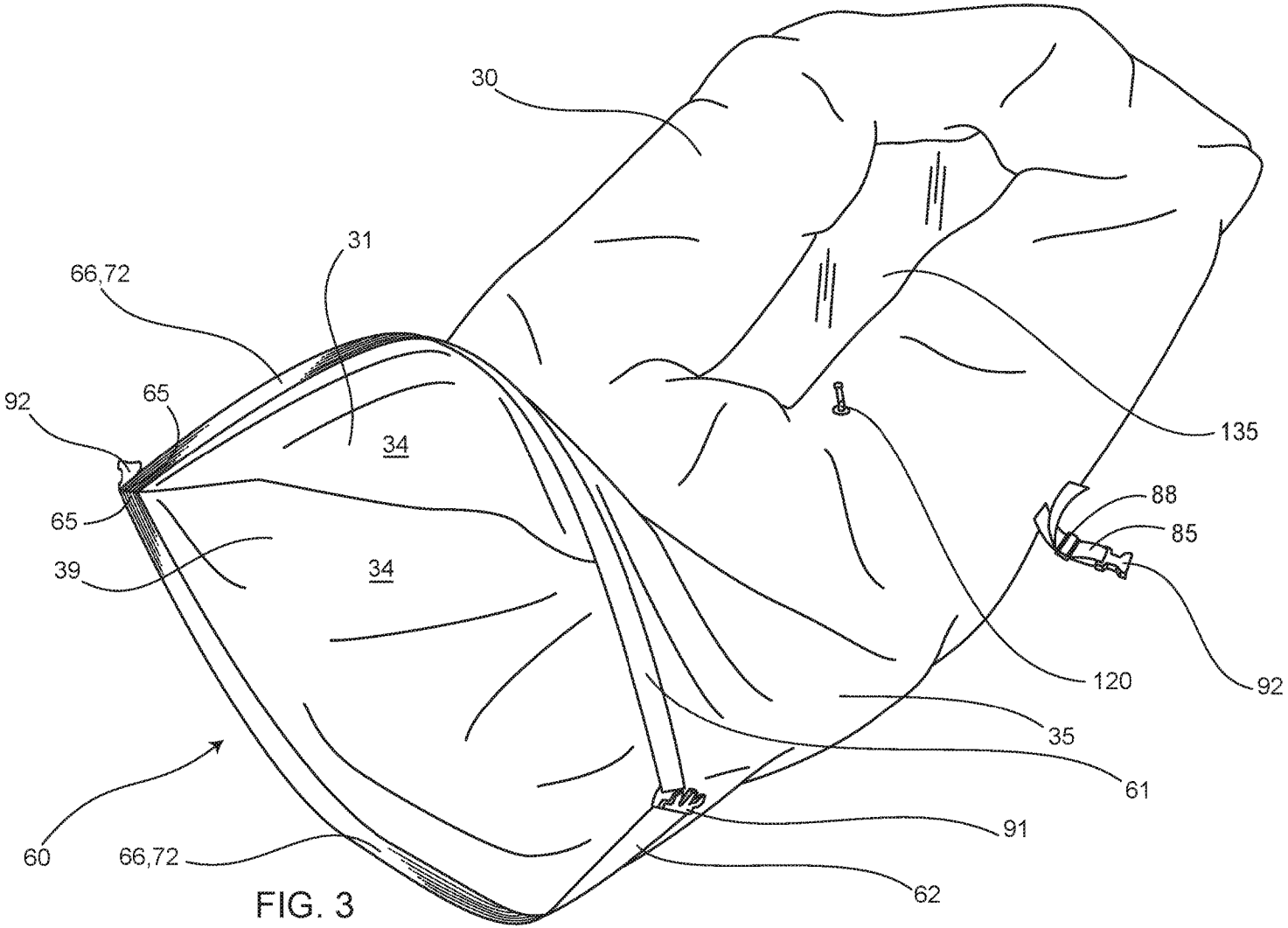
FIG. 3 is a perspective view of the invention, illustrating a first end of the bladder in an open configuration.
Figure 4:
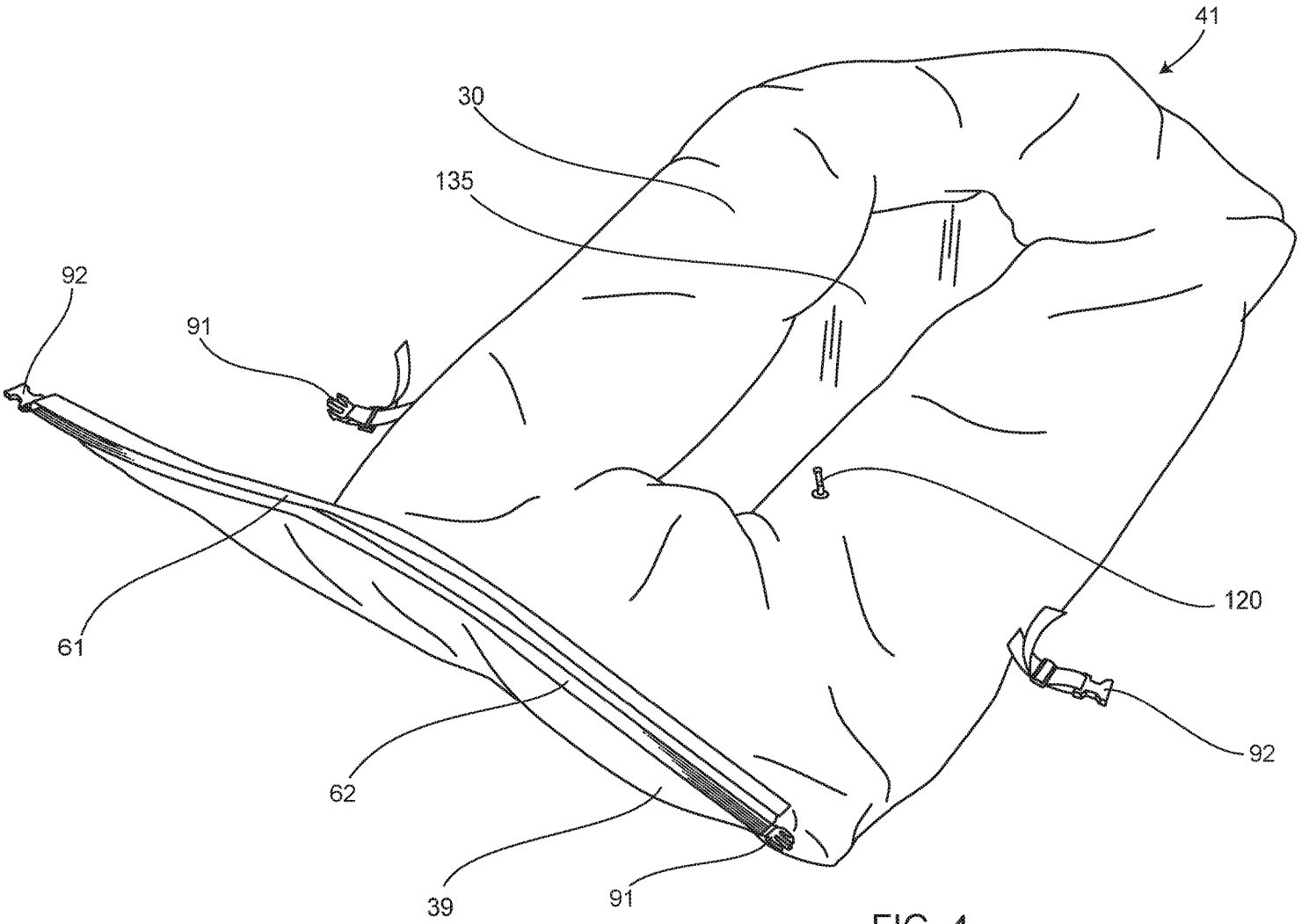
FIG. 4 is a perspective view of the invention, illustrating the first end of the bladder in a closed configuration.
Figure 5:
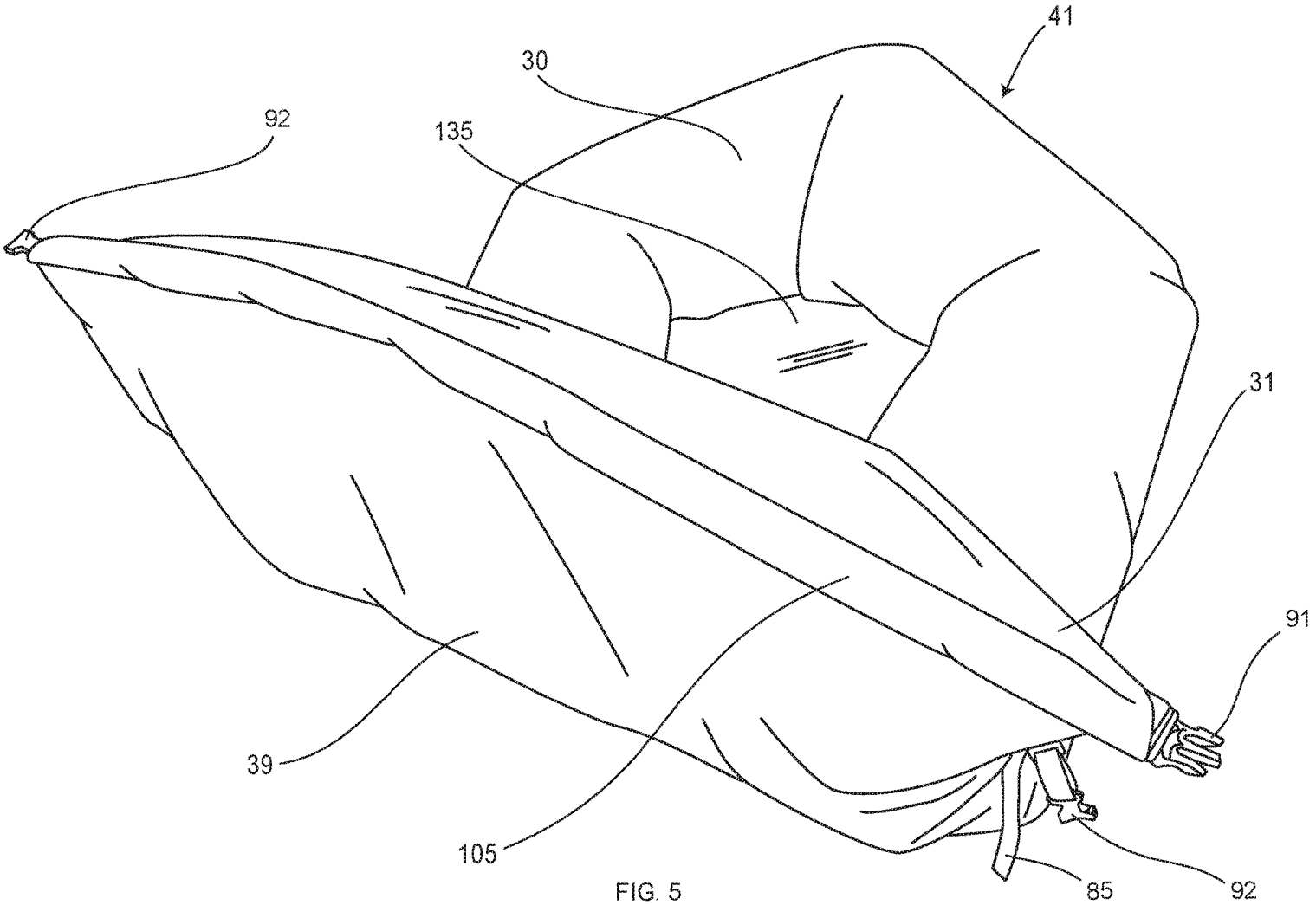
FIG. 5 is a perspective view of the invention, illustrating the first end of the bladder in a rolled configuration.

The first seal 50 preferably includes a resilient top seal strip 61 fixed with the interior surface 34 of the top side 31 of the bladder 30 proximate the open first end 32 of the bladder 30, as well as an opposing, resilient bottom seal strip 62 fixed with the interior surface 34 of the bottom side 39 of the bladder 30 proximate the open first end 32 of the bladder 30. The top and bottom seal strips 61,62 are resiliently urged together in parallel alignment at substantially flat contact surfaces 66 thereof to seal the first end 32 of the bladder 30. Opposing ends 65 of each strip 61,62 are mutually fixed at the sides 35 of the bladder 30 (FIG. 3). In some embodiments the first end 32 of the bladder 30 further includes a leader 100 having a substantially-consistent cross-sectional shape, such that upon sealing of the first seal 50, the first end 32 of the bladder 30 may be rolled tightly towards the second end 38 of the bladder 30 in a rolled configuration 105 (FIG. 5), and then fixed with the two-part mechanical fasteners 80 to reinforce the first seal 50.

Each strip 61,62 preferably includes an elastomeric material on the contact surfaces 65 thereof for inhibiting leaking of air from the bladder 30. Likewise, each contact surface 66 may include a tacky material 72 for temporary mutual air-tight adhesion between the contact surfaces 66. Alternately the contact surfaces 66 may be mutually magnetically attractive, or use some combination of magnets and the tacky material 72 and the elastomeric material.

Figure 9:
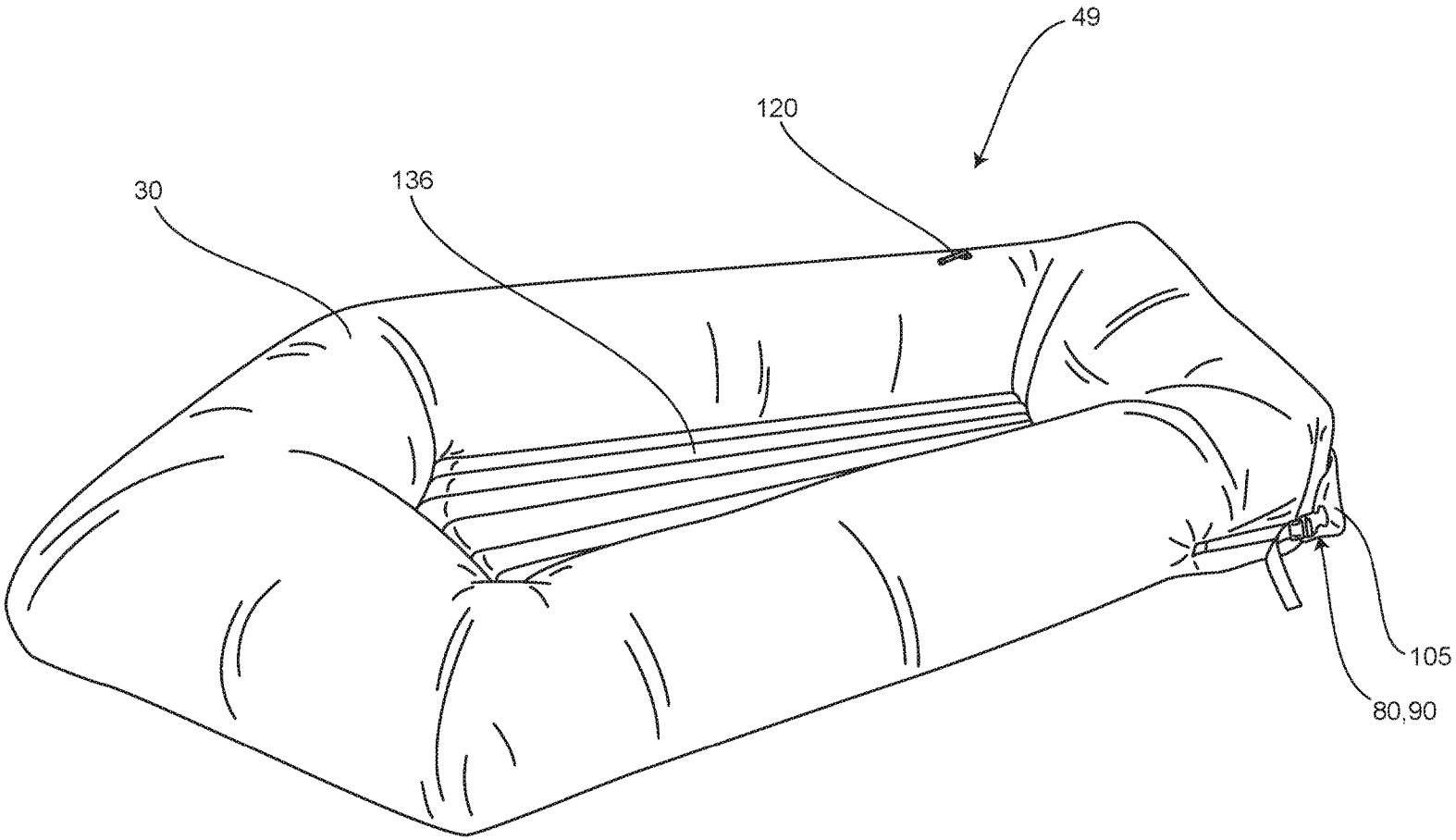
FIG. 9 is a perspective view of the invention, illustrating an embodiment having an inflatable floor.
Figure 10:
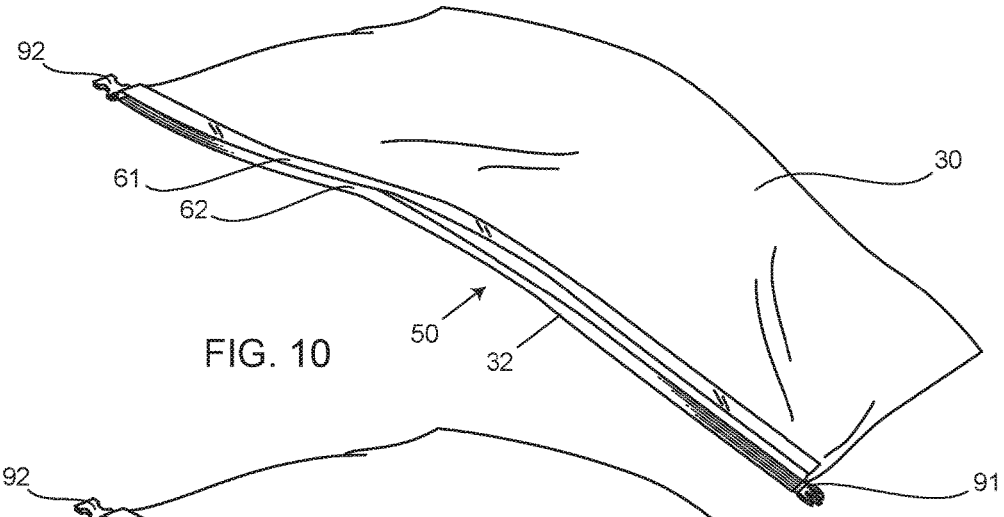
FIG. 10 is a perspective view of a first seal of the first end of the bladder.

Preferably the watercraft 10 includes a pair of two-part mechanical fasteners that are each fixed between one of the two opposing lateral sides 35 of the bladder 30 and the first end 32 of the bladder 30, preferably at the ends 65 of the strips 61,62 (FIGS. 3 and 6). As such, when the first seal 50 is in the closed configuration 70, each mechanical fastener 80 may be fastened to secure the first end 32 of the bladder 30 to one of the lateral sides 35 of the bladder 30 to maintain the closed configuration 70 of the seal 50 (FIGS. 7 and 9). In one embodiment (FIGS. 3, 4 and 10), the two-part mechanical fasteners are each fixed at the ends 65 of the strip 61 or, alternatively, at the ends 65 of the strip 62, such that the complimentary strip 61, 62 can bend a corner slidingly independent of the fastening strip and thereby avoid any openings in the seal that can otherwise be caused by competing radii in the bend. Preferably each two-part mechanical fastener 80 includes a mechanical snap-fit buckle 90 having a plastic clip 91 and a plastic receiver 92. Each clip 91 and receiver 92 is fixed to the bladder 30 with a flexible strap 85, such as a nylon strap.

Ideally each mechanical fastener 80 further includes a strap length adjustment portion 88, such that the sealed or closed first end 32 of the bladder 30 may be cinched closer to the second end 38 of the bladder 30 by tightening the straps 85 of either mechanical fastener 80 to increase rigidity of the watercraft 10 by increasing air pressure within the bladder 30 by shrinking the internal volume 36.

Figure 11:
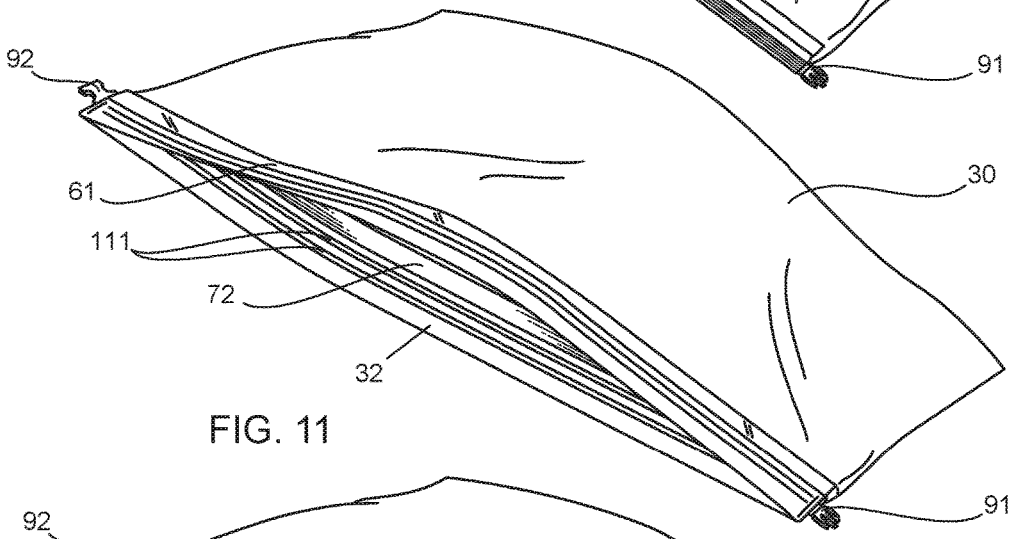
FIG. 11 is a perspective view of a second zip-lock type seal of the first end of the bladder.
Figure 12:
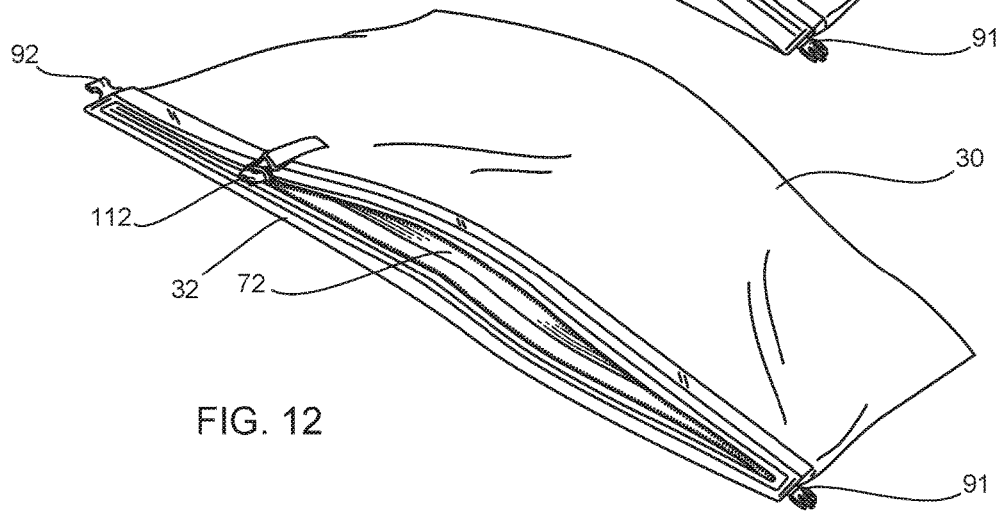
FIG. 12 is a perspective view of a second zipper-type seal of the first end of the bladder.
Figure 13:
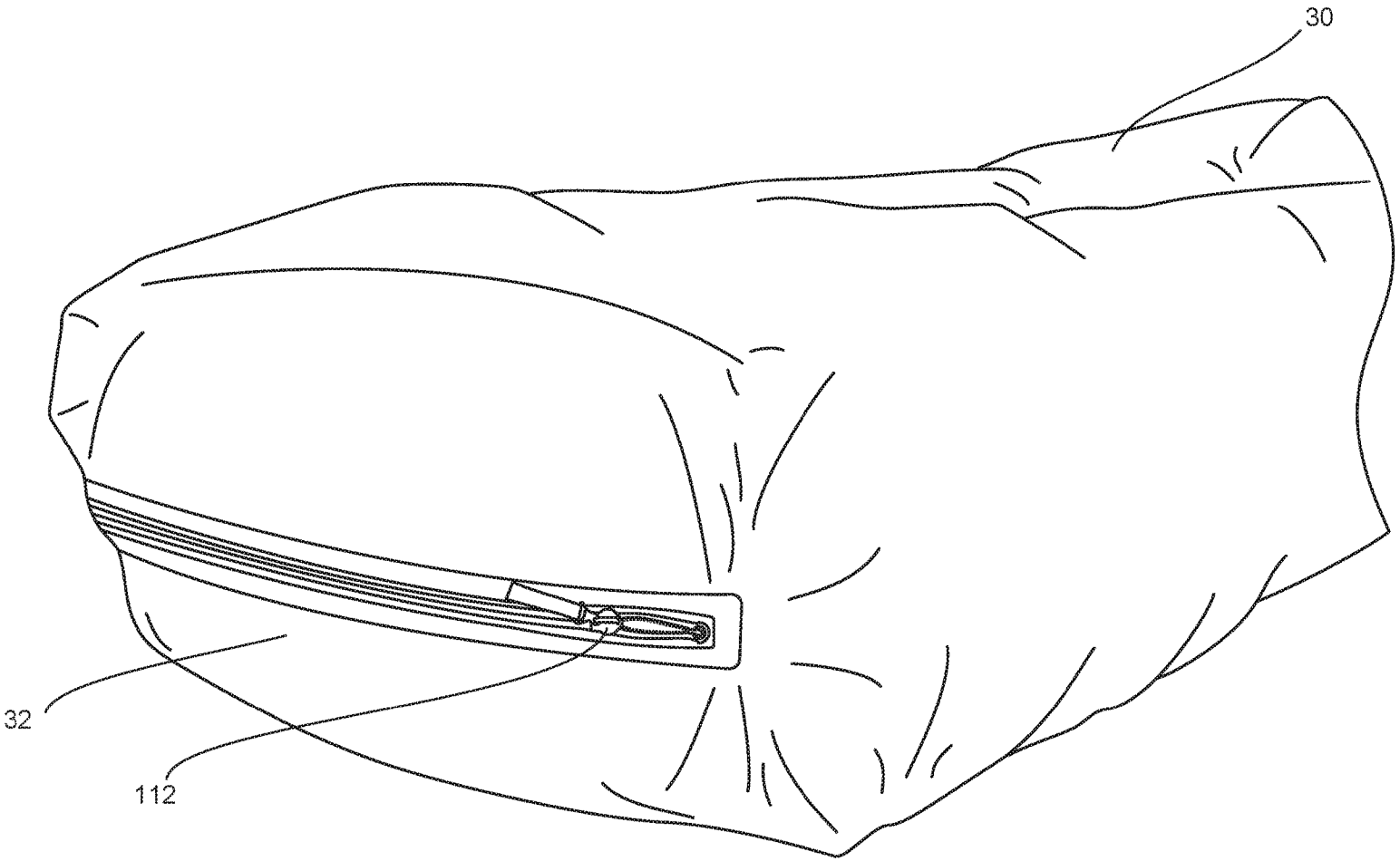
FIG. 13 is an enlarged partial view of the first end of the bladder showing the second seal as a zipper-type seal.

In some embodiments, the watercraft 100 further includes a second seal 110 (FIGS. 11-12) between the first seal 50 and the open first end 32 of the bladder 30. The second seal 110 facilitates the maintaining of the inflated configuration 41 of the bladder 30, and may include a zip-lock type of seal 111 (Ziploc®, or more descriptively "zip-lock", is a trademark of S. C. Johnson having the inherent meaning of a resealable closure with interlocking grooves and ridges) between the top side 31 and bottom side 39 interior surfaces 34 of the bladder 30 proximate the first end 32 thereof. Alternately the second seal 110 includes a zipper fastener 112 (FIGS. 12 and 13).

Figure 14:
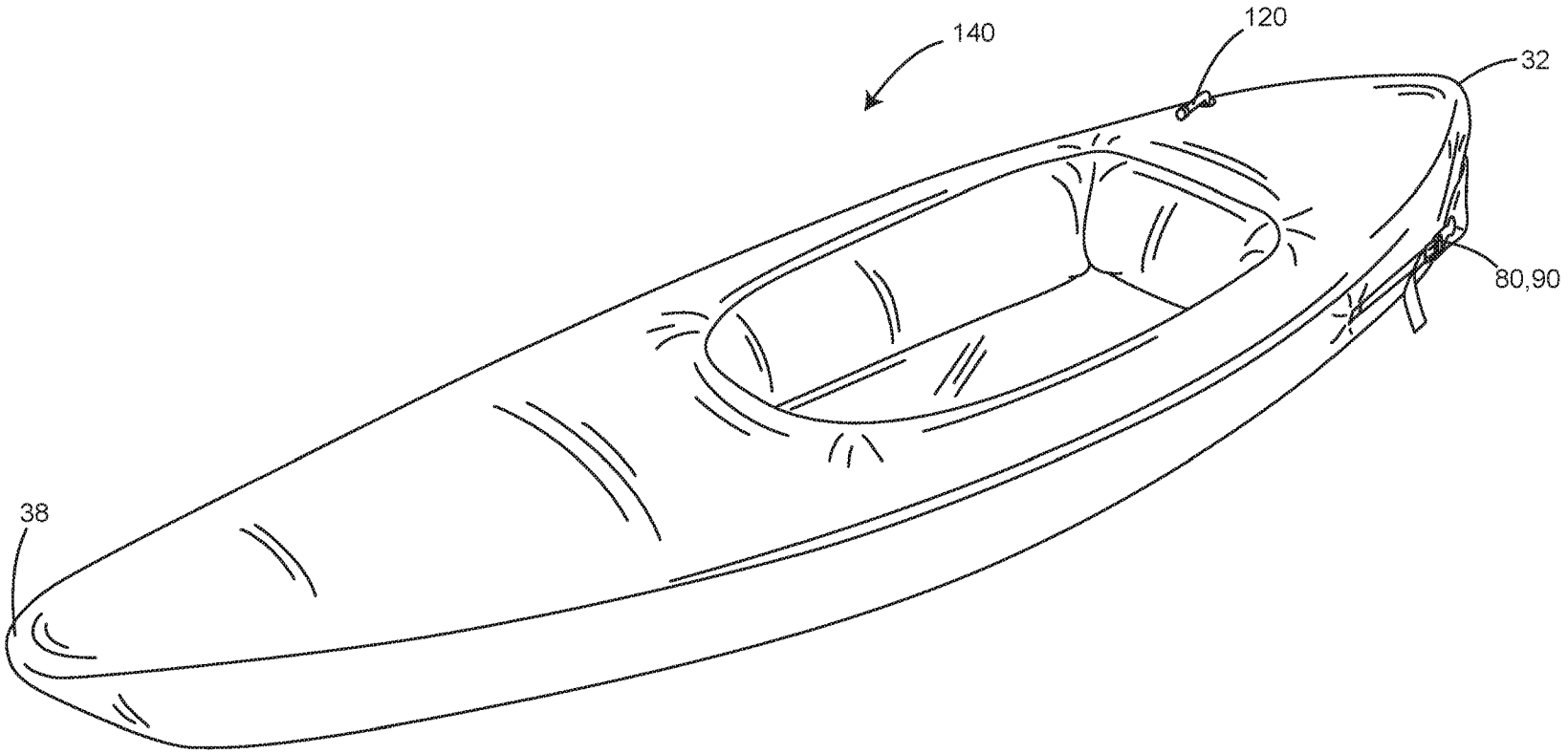
FIG. 14 is a perspective view of the invention wherein the watercraft form is that of a kayak.
Figure 15:
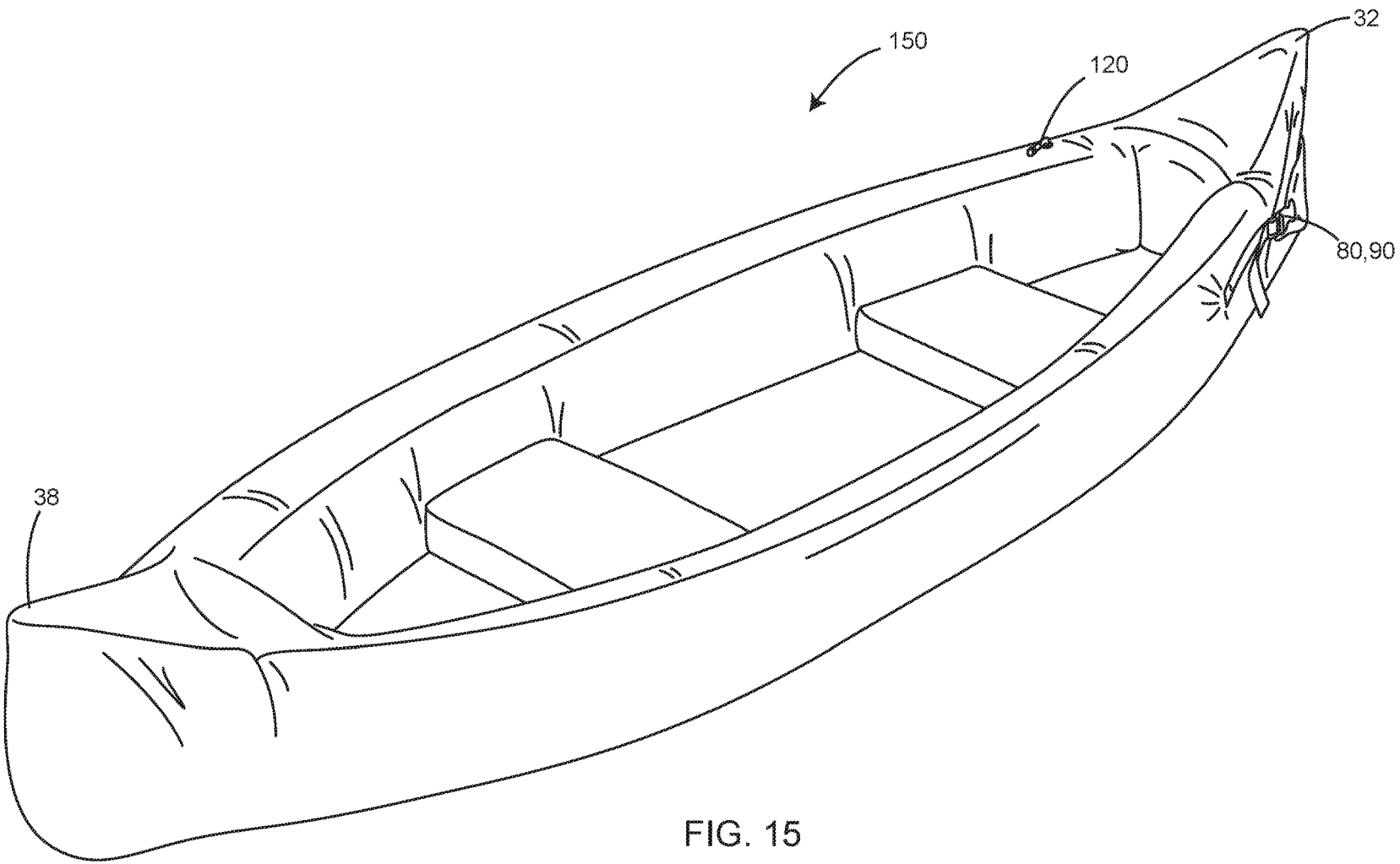
FIG. 15 is a perspective view of the invention wherein the watercraft form is that of a canoe.
Figure 16:
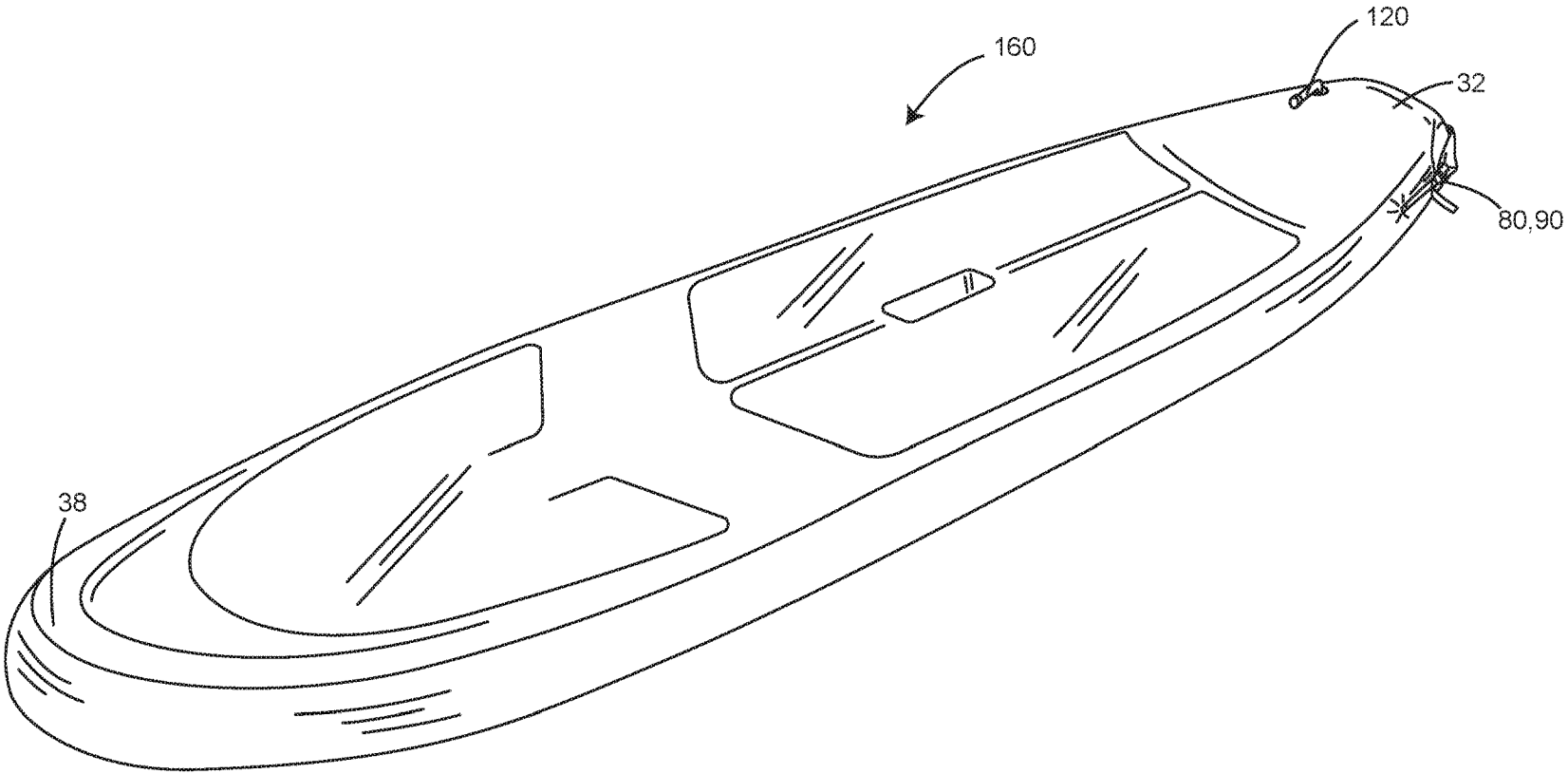
FIG. 16 is a perspective view of the invention wherein the watercraft form is that of a stand-up paddle board.
Figure 17:
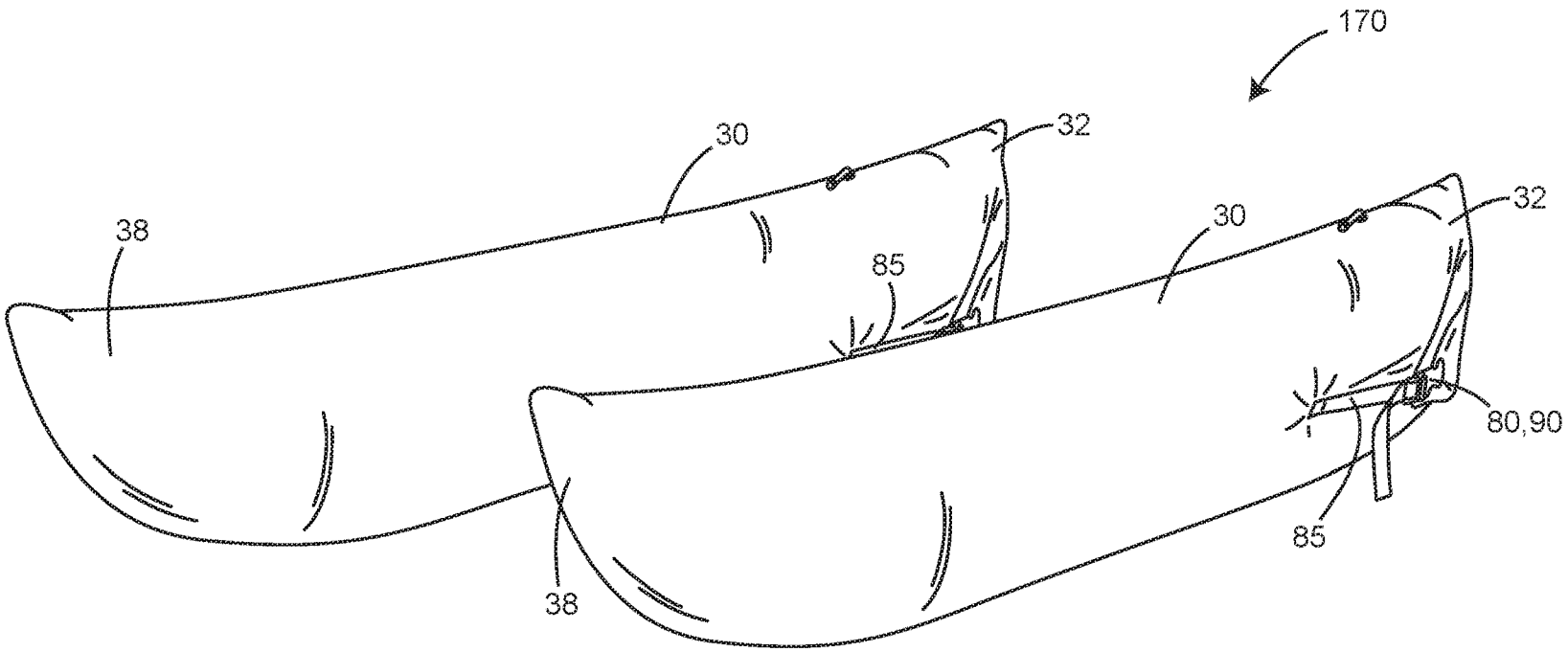
FIG. 17 is a perspective view of the invention wherein the watercraft form is that of a cataraft.

The watercraft form 40 may take various shapes, such as an inflatable boat 130 having a floor 135 (FIGS. 1-7). In at least one embodiment the floor 135 is inflatable and integrated with the bladder 30, or may include a separate air bladder 136 inflatable with conventional means such as by mouth or air pump (FIG. 9). Alternately the watercraft form 40 may be that of a kayak 140 (FIG. 14), a canoe (FIG. 15), a stand-up paddle board 160 (FIG. 16), a cataraft 170 (FIG. 17) having two of the bladders 30 in a substantially parallel configuration, such bladders 30 being connected by some type of support structure (not shown) as is known in the art. The open first end 32 of the bladder 30 is preferably at the stern of the watercraft form 40, but may also be along one side of the watercraft form 40 between the stern and a bow thereof, along the top surface 31, or along the bottom surface 39 (not shown). The open end 32 may feed multiple bladders 30 simultaneously (not shown), or each bladder 30 may include multiple open ends 32 (not shown). Likewise, other watercraft forms 40 may be utilized, such as water skis, drift boats, inner tubes, various types of floating rafts, or the like (all not shown).

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An inflatable watercraft for supporting a user on water, comprising:

a flexible water-proof bladder having a first end, an opposing second end, a top side, a bottom side, and two opposing lateral sides, the bladder assuming a watercraft form when inflated with air, at least one third of the first end open to expose an interior surface of the bladder and an interior volume of the bladder; and a first seal fixed with the interior surface of the bladder proximate the open first end of the bladder, the first seal having a resilient top seal strip fixed with the interior surface of the top side of the bladder proximate the open first end of the bladder and an opposing resilient bottom seal strip fixed with the interior surface of the bottom side of the bladder proximate the open first end of the bladder, the top and bottom seal strips resiliently urged together in parallel alignment at substantially flat contact surfaces thereof to seal the first end of the bladder, the contact surfaces of the top and bottom seal strips including a tacky, or otherwise sufficiently sticky, material for temporary mutual adhesion between the contact surfaces, the first seal configured for assuming an open configuration and a closed configuration;

whereby to inflate the watercraft the user holds the first seal open while scooping air into the bladder until the bladder is sufficiently inflated, whereupon the user closes the first seal to form the inflated watercraft.

2. The inflatable watercraft of claim 1 wherein the contact surfaces of the top and bottom seal strips include an elastomeric material.

3. The inflatable watercraft of claim 1 wherein the top and bottom seal strips are magnetically mutually attractive.

4. The inflatable watercraft of claim 1 further including a pair of two-part mechanical fasteners, each fixed between one of the two opposing lateral sides of the bladder and first end, whereby when the first seal is in the closed configuration, each mechanical fastener may be fastened to secure the first end of the bladder to one of the lateral sides of the bladder to maintain the closed configuration of the first seal.

5. The inflatable watercraft of claim 4 wherein each two-part mechanical fastener includes a mechanical snap-fit buckle having a clip and a receiver, each clip and receiver fixed to the bladder with a flexible strap.

6. The inflatable watercraft of claim 5 wherein the snap-fit buckle further includes a strap length adjustment portion, whereby the sealed first end of the bladder may be cinched closer to the second end of the bladder by tightening the straps of either mechanical fastener to increase rigidity of the watercraft.

7. The inflatable watercraft of claim 4 wherein the first end of the bladder includes a leading extension having a substantially-consistent cross-sectional shape, whereby upon sealing of the first seal the first end may be rolled tightly towards the second end and fixed with the two-part mechanical fasteners to reinforce the first seal.

8. The inflatable watercraft of claim 1 further including a second seal between the first seal and the open first end of the bladder, the second seal facilitating the maintaining of the inflated configuration of the bladder.

9. The inflatable watercraft of claim 8 wherein the second seal is a zip-lock type of seal between the top and bottom side interior surfaces of the bladder proximate the first end thereof.

10. The inflatable watercraft of claim 8 wherein the second seal is a zipper fastener between the top and bottom side interior surfaces of the bladder proximate the first end thereof.

11. The inflatable watercraft of claim 1 further including a pair of two-part mechanical snap-fit buckles each having a clip and a receiver, and each fixed between one of the two opposing lateral sides of the bladder and one of the two opposing ends of each strip seal, each clip and receiver fixed to the bladder with a flexible strap, whereby when the first seal is in the closed configuration, each mechanical fastener may be fastened to secure the first end of the bladder to one of the lateral sides of the bladder to maintain the closed configuration of the first seal.

12. The inflatable watercraft of claim 11 wherein the first end of the bladder includes a leading extension having a substantially-consistent cross-sectional shape, whereby upon sealing of the first seal the first end may be rolled tightly towards the second end and fixed with the snap-fit buckles to reinforce the first seal.

13. The inflatable watercraft of claim 1 further including an auxiliary air valve in fluid communication with the interior volume of the bladder.

14. The inflatable watercraft of claim 1 wherein the watercraft form is an inflatable boat with a floor.

15. The inflatable watercraft of claim 1 wherein the watercraft form is a kayak or canoe.

16. The inflatable watercraft of claim 1 wherein the watercraft form is a paddle-board.

17. The inflatable watercraft of claim 1 wherein the watercraft form is a cataraft having two of the bladders in a substantially parallel configuration.

18. The inflatable watercraft of claim 1 wherein the first end is a side of the watercraft between a stern and a bow of the watercraft.

* * * * *